US009532659B2

(12) United States Patent
Tsui et al.

(10) Patent No.: US 9,532,659 B2
(45) Date of Patent: Jan. 3, 2017

(54) SLIDING DOOR ASSEMBLY FOR A REFRIGERATED DISPLAY CASE

(71) Applicant: Anthony, Inc., Sylmar, CA (US)

(72) Inventors: Harvey Tsui, Valencia, CA (US); Matthew Walp, Valencia, CA (US)

(73) Assignee: Anthony, Inc., Sylmar, CA (US)

( * ) Notice: Subject to any disclaimer, the term of this patent is extended or adjusted under 35 U.S.C. 154(b) by 0 days.

(21) Appl. No.: 14/705,558

(22) Filed: May 6, 2015

(65) Prior Publication Data

US 2016/0324335 A1 Nov. 10, 2016

(51) Int. Cl.

| | |
|---|---|
| ***A47B 88/00*** | (2006.01) |
| ***A47F 3/00*** | (2006.01) |
| ***E05D 15/06*** | (2006.01) |
| ***E05F 5/00*** | (2006.01) |
| ***E05F 5/06*** | (2006.01) |
| ***E05F 11/54*** | (2006.01) |

(Continued)

(52) U.S. Cl.

CPC ..... *A47F 3/005* (2013.01); *E05D 15/0643* (2013.01); *E05D 15/0652* (2013.01); *E05D 15/0678* (2013.01); *E05F 3/22* (2013.01); *E05F 5/003* (2013.01); *E05F 5/06* (2013.01); *E05F 11/54* (2013.01); *E06B 3/4636* (2013.01)

(58) Field of Classification Search

CPC ..... E06B 3/4636; E05D 15/0643; E05F 1/02; E05F 1/025; E05C 17/56

See application file for complete search history.

(56) References Cited

U.S. PATENT DOCUMENTS 2,479,839 A * 8/1949 Ives ..... E05D 15/0643 16/88
3,143,758 A * 8/1964 Dunham ..... E05D 15/0643 16/88

(Continued)

FOREIGN PATENT DOCUMENTS

DE 1020110 87 036 5/2013
IT WO 2014037969 A1 * 3/2014 ..... E05D 13/14

(Continued)

OTHER PUBLICATIONS

U.S. Appl. No. 14/460,973, filed Aug. 15, 2014, Aanthony International.

*Primary Examiner* — Katherine Mitchell
*Assistant Examiner* — Abe Massad
(74) *Attorney, Agent, or Firm* — Foley & Lardner LLP

(57) ABSTRACT

A sliding door assembly for a refrigerated display case is provided. The sliding door assembly includes a door frame having a top frame segment and a plurality of sliding bearings that slide along channels within the top frame segment. A plurality of display case doors are coupled to the sliding bearings and configured to slide, along with the sliding bearings, between an open position and a closed position. The display case doors may be suspended from the sliding bearings. The sliding door assembly may include an automatic closure system coupled to the display case doors and configured to apply a closing force that automatically returns the display case doors to the closed position. One or more magnets may apply a magnetic damping force as the display case doors approach the closed position to facilitate a soft closure of the display case doors.

13 Claims, 16 Drawing Sheets

(51) Int. Cl.
*E06B 3/46* (2006.01)
*E05F 3/22* (2006.01)

(56) References Cited

U.S. PATENT DOCUMENTS

| | | | | |
|---|---|---|---|---|
| 4,126,912 | A * | 11/1978 | Johnson | E05D 15/0665 16/105 |
| 4,301,623 | A * | 11/1981 | Demukai | E05F 1/16 16/78 |
| 4,941,289 | A | 7/1990 | Rolek | |
| 5,111,618 | A | 5/1992 | Kaspar et al. | |
| 5,175,975 | A | 1/1993 | Benson et al. | |
| 5,522,216 | A | 6/1996 | Park et al. | |
| 5,843,353 | A | 12/1998 | De Vos et al. | |
| 6,298,615 | B1 | 10/2001 | Richardson | |
| 6,367,223 | B1 | 4/2002 | Richardson et al. | |
| 6,606,832 | B2 | 8/2003 | Richardson et al. | |
| 6,606,833 | B2 | 8/2003 | Richardson et al. | |
| 6,868,688 | B2 | 3/2005 | Narehood | |
| 6,938,968 | B2 | 9/2005 | Tanimoto et al. | |
| 7,156,478 | B2 | 1/2007 | Harn et al. | |
| 7,686,405 | B2 * | 3/2010 | Trulaske, Sr. | E05F 1/025 16/81 |
| 7,770,259 | B2 * | 8/2010 | Janson | E05D 15/0652 104/89 |
| 8,393,130 | B2 | 3/2013 | Stubblefield | |
| 2010/0242370 | A1 * | 9/2010 | Trulaske, Sr. | E05D 13/14 49/410 |
| 2012/0297813 | A1 | 11/2012 | Hanley et al. | |
| 2013/0020815 | A1 * | 1/2013 | Smith | E05C 17/56 292/251.5 |
| 2013/0285517 | A1 | 10/2013 | Wach et al. | |
| 2015/0250332 | A1 | 9/2015 | Mille et al. | |
| 2015/0252603 | A1 * | 9/2015 | Cianetti | E05D 13/14 49/119 |

FOREIGN PATENT DOCUMENTS

| | | |
|---|---|---|
| WO | WO-2014/020394 | 2/2014 |
| WO | WO-2014/044330 | 3/2014 |

* cited by examiner

SLIDING DOOR ASSEMBLY FOR A REFRIGERATED DISPLAY CASE

BACKGROUND

The present invention relates generally to refrigerated display cases and more particularly to a sliding door assembly for a refrigerated display case.

Refrigerated display cases (e.g., a refrigerators, freezers, refrigerated merchandisers, etc.) are used in a wide variety of commercial, institutional, and residential applications for storing and/or displaying refrigerated or frozen items. For example, self-service type refrigerated display cases or merchandisers are often used in grocery stores, supermarkets, convenience stores, florist shops, and other commercial settings to store and display temperature-sensitive consumer goods (e.g., food products and the like).

Many refrigerated display cases have a display case door (e.g., a door with an insulated glass panel) through which items within the refrigerated display case can be viewed. In some refrigerated display cases, the door is hingedly attached to a frame and swings open relative to the frame to facilitate consumer access to the refrigerated or frozen items. Other refrigerated display cases use sliding doors that move linearly relative to the frame.

Previous sliding door type refrigerated display cases suffer from a number of disadvantages. For example, the sliding doors are often designed to slide along a track at the bottom of the door frame. The bottom track can collect debris and must be regularly cleaned to ensure proper operation of the sliding doors. Sliding doors can be difficult to open and close due to the weight of the doors being supported by the bottom track, resulting in a friction force which must be overcome when sliding the doors along the bottom track. Additionally, sliding doors often fail to return to the closed position when not in use. It would be desirable to provide a sliding door assembly for a refrigerated display case that overcomes these and other disadvantages.

SUMMARY

One implementation of the present disclosure is a sliding door assembly for a refrigerated display case. The sliding door assembly includes a door frame having a top frame segment that defines one or more substantially horizontal and parallel channels. The sliding door assembly includes a plurality of sliding bearings positioned within the one or more substantially parallel channels. The sliding bearings are configured to slide along the top frame segment within the one or more substantially parallel channels. The sliding door assembly includes a plurality of display case doors coupled to the plurality of sliding bearings and configured to slide, along with the plurality of sliding bearings, between an open position and a closed position. The sliding door assembly includes an automatic closure system coupled to the plurality of display case doors and configured to apply a closing force that automatically returns the plurality of display case doors to the closed position. The sliding door assembly includes one or more magnets coupled to the door frame and configured to apply a magnetic damping force as the plurality of display case doors approach the closed position. The magnetic damping force opposes the closing force applied by the automatic closure system and dampens a closure of the plurality of display case doors.

In some embodiments, the plurality of display case doors are suspended from the plurality of sliding bearings.

In some embodiments, the top frame segment defines a plurality of substantially parallel channels including a front channel and a rear channel. The plurality of sliding bearings may include a front set of sliding bearings that slide within the front channel and a rear set of sliding bearings that slide within the rear channel. The plurality of display case doors may include a front display case door suspended from the front set of sliding bearings and a rear display case door suspended from the rear set of sliding bearings.

In some embodiments, the top frame segment has an open bottom face. Each of the plurality of display case doors may include a suspension frame segment along a top of the display case door. Each suspension frame segment may extend through the open bottom face of the top frame segment and attach to one or more of the plurality of sliding bearings.

In some embodiments, each of the plurality of sliding bearings includes a body and a post extending substantially horizontally from the body. The body may include a ball bearing carriage and may be configured to slide substantially horizontally within the top frame segment. The plurality of display case doors may be suspended from the posts.

In some embodiments, the plurality of sliding bearings include a magnetic material. The one or more magnets may magnetically engage the plurality of sliding bearings as the plurality of display case doors approach the closed position.

In some embodiments, the one or more magnets are fixed to the top frame segment. In some embodiments, least one of the one or more magnets is fixed to an exterior of the top frame segment and configured to apply the magnetic damping force through the top frame segment.

In some embodiments, the one or more magnets are configured to apply a magnetic holding force when the plurality of display case doors are in the open position. The magnetic holding force may oppose the closing force applied by the automatic closure system and may hold the plurality of display case doors in the open position.

In some embodiments, at least one of the one or more magnets is configured to apply both the magnetic damping force to one of the plurality of display case doors and the magnetic holding force to another of the plurality of display case doors.

In some embodiments, the sliding door assembly includes one or more latches configured to engage the plurality of display case doors in the open position and to hold the plurality of display case doors in the open position.

In some embodiments, each of the plurality of sliding bearings has a height in a vertical direction and a depth in a horizontal direction substantially perpendicular to a direction that the sliding bearing slides. The height of each of each sliding bearing may exceed its depth.

Another implementation of the present disclosure is a sliding door assembly for a refrigerated display case. The sliding door assembly includes a door frame having a top frame segment that defines one or more substantially horizontal and parallel channels. The sliding door assembly includes a plurality of sliding bearings positioned within the one or more substantially parallel channels. The plurality of sliding bearings are configured to slide along the top frame segment within the one or more substantially parallel channels. The sliding door assembly includes a plurality of display case doors coupled to the plurality of sliding bearings. The plurality of display case doors are configured to slide, along with the plurality of sliding bearings, between an open position and a closed position. The sliding door assembly includes a weight system coupled to the plurality of display case doors. The weight system is configured to apply a closing force that automatically returns the plurality of display case doors to the closed position.

In some embodiments, the sliding door assembly includes one or more latches configured to engage the plurality of display case doors in the open position and to hold the plurality of display case doors in the open position.

In some embodiments, the sliding door assembly includes one or more magnets coupled to the door frame and configured to apply a magnetic damping force as the plurality of display case doors approach the closed position. The magnetic damping force may oppose the closing force applied by the weight system and may dampen a closure of the plurality of display case doors.

In some embodiments, the door frame further includes a first side frame segment and a second side frame segment opposite the first side frame segment. The top frame segment may extend substantially horizontally between the first side frame segment and the second side frame segment.

In some embodiments, the weight system includes a first weight suspended within the first side frame segment a second weight suspended within the second side frame segment. The first weight may be coupled to a first display case door of the plurality of display case doors. The second weight may be coupled to a second display case door of the plurality of display case doors.

In some embodiments, the weight system includes a first cable suspending the first weight within the first side frame segment and a second cable suspending the first weight within the first side frame segment. The first cable may extend upward from the first weight, bend around a first cable guide that redirects the first cable substantially horizontally, and apply a horizontal closing force to the first display case door. The second cable may extend upward from the second weight, bend around a second cable guide that redirects the second cable substantially horizontally, and apply a horizontal closing force to the second display case door.

Another implementation of the present disclosure is a sliding door assembly for a refrigerated display case. The sliding door assembly includes a door frame having a top frame segment that defines a front channel and a rear channel substantially parallel to the front channel. The sliding door assembly includes a plurality of sliding bearings including a front set of sliding bearings and a rear set of sliding bearings. The front set of sliding bearings is positioned within the front channel and configured to slide along the top frame segment within the front channel. The rear set of sliding bearings is positioned within the rear channel and configured to slide along the top frame segment within the rear channel. The sliding door assembly includes a plurality of display case doors including a front display case door and a rear display case door. The front display case door is coupled to the front set of sliding bearings and configured to slide with the front set of sliding bearings along the front channel. The rear display case door is coupled to the rear set of sliding bearings and configured to slide with the rear set of sliding bearings along the rear channel. The sliding door assembly includes an automatic closure system coupled to the plurality of display case doors. The automatic closure system is configured to apply a closing force that automatically returns the plurality of display case doors to a closed position.

In some embodiments, the automatic closure system includes one or more weights suspended within opposing side segments of the door frame. Each of the weights may be coupled to one of the plurality of display case doors via a cable.

In some embodiments, the automatic closure system includes one or more magnets coupled to the door frame. The one or magnets may be configured to apply a magnetic damping force as the plurality of display case doors approach the closed position. The magnetic damping force may oppose the closing force applied by the automatic closure system and may dampen a closure of the plurality of display case doors.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Figure 1:
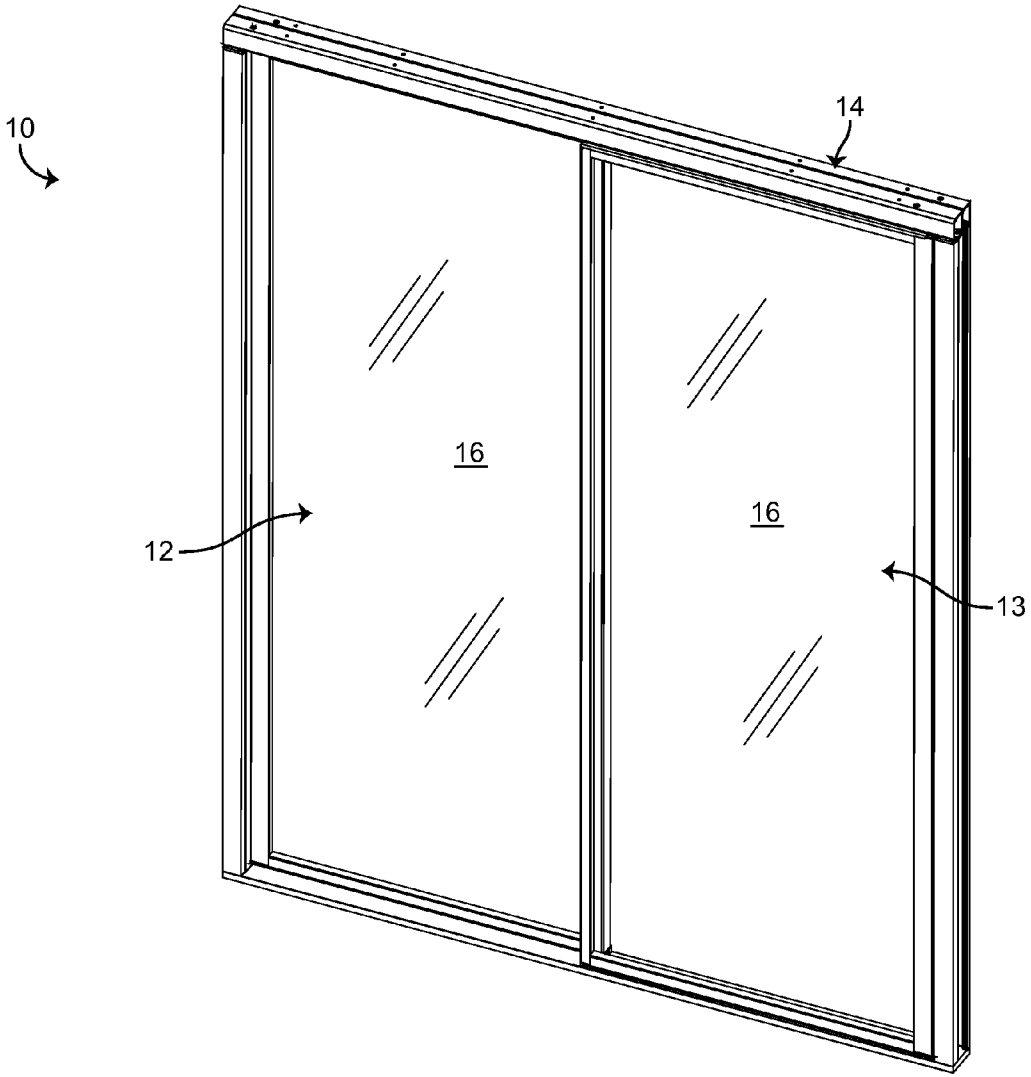
FIG. 1 is a drawing of a sliding door assembly including a plurality of display case doors and a perimeter frame, according to an exemplary embodiment.

Referring generally to the FIGURES, a sliding door assembly for a refrigerated display case and components thereof are shown, according to various exemplary embodiments. The sliding door assembly described herein includes a perimeter frame and a plurality of display case doors that slide linearly (i.e., horizontally) along a top frame segment of the perimeter frame. Each of the display case doors is coupled to one or more sliding bearings that slide substantially horizontally within a channel defined by the top frame segment of the perimeter frame (e.g., a front channel, a rear channel, etc.). The display case doors may slide relative to the perimeter frame, along with the sliding bearings, between an open position and a closed position.

In some embodiments, the display case doors are suspended from the sliding bearings. For example, each sliding bearing may include a body (e.g., a ball bearing carriage) that slides within the top segment of the perimeter frame and a post that extends substantially horizontally from the body. The display case doors may include a suspension frame segment along a top of each door. The suspension frame segment may include one or more hooks or other coupling features that allow the display case doors to be suspended from the posts that extend from the sliding bearings. The top frame segment of the perimeter frame may have an open bottom face which allows the display case doors to attach to the sliding bearings.

In some embodiments, the perimeter frame has a bottom frame segment with a substantially flat upper surface. The flat upper surface of the bottom frame segment results in a bottom frame segment that is completely gutterless (i.e., without a track, channel, or gutter within the bottom frame segment). Advantageously, the gutterless design facilitates cleaning and prevents the bottom frame segment from collecting debris which could interfere with the sliding of the display case doors.

In some embodiments, the sliding door assembly includes an automatic closure system configured to automatically return the display case doors to the closed position. The automatic closure system may include one or more weights suspended within side segments of the perimeter frame. The weights may be suspended from cables that connect the weights to the display case doors. The automatic closure system may include an L-shaped housing or pulley at the top of each side frame segment to redirect the cables to apply a horizontal closing force to the display case doors.

In some embodiments, the sliding door assembly includes one or magnets coupled to the door frame. The magnets may be configured to apply a magnetic damping force as the plurality of display case doors approach the closed position. For example, the sliding bearings may be constructed from a magnetic material that is attracted to the magnets as the display case doors move past the magnets. The magnetic damping force opposes the closing force applied by the automatic closure system and dampens (i.e., slows) the movement of the display case doors as the doors approach the closed position. Advantageously, the magnetic damping force facilitates a soft closure of the display case doors.

In some embodiments, the magnets also function to hold the display case doors in the open position. For example, one or more of the magnets may apply a magnetic damping force to one display case door and a magnetic holding force to another display case door. The positions of the magnets may be selected such that each magnet is capable of providing both the magnetic damping force and the magnetic holding force (e.g., to different doors, to the same door, etc.). A mechanical latch may also be used to hold the display case doors in the open position. These and other features and advantages of the sliding door assembly are described in greater detail below.

Before discussing further details of the sliding door assembly and/or the components thereof, it should be noted that references to "front," "back," "rear," "upward," "downward," "inner," "outer," "right," and "left" in this description are merely used to identify the various elements as they are oriented in the FIGURES. These terms are not meant to limit the element which they describe, as the various elements may be oriented differently in various applications.

Referring now to FIG. 1, a sliding door assembly 10 for a refrigerated display case is shown, according to an exemplary embodiment. Sliding door assembly 10 may be used in conjunction with a temperature-controlled display device (e.g., a refrigerator, a freezer, a refrigerated merchandizer, etc.) for storing and/or displaying refrigerated or frozen goods. For example, sliding door assembly 10 may be implemented as part of a refrigerated display case in a supermarket, warehouse store, convenience store, kitchen, or other similar facility.

Sliding door assembly 10 is shown to include a plurality of display case doors 12-13 mounted in a perimeter frame 14. Each display case door includes a transparent unit 16. Transparent unit 16 acts as a physical and thermal barrier between the interior of the refrigerated display case and the environment external to the refrigerated display case to help to maintain the interior of the refrigerated display case at a desired temperature. In some embodiments, transparent unit 16 includes one or more panes of transparent or substantially transparent glass (e.g., insulated glass, tempered glass, non-tempered glass, etc.), plastics, or other transparent or substantially transparent materials through which the items stored within the refrigerated display case can be viewed.

Transparent unit 16 may include multiple layers of transparent panes (i.e., multiple panes per display case door). In some embodiments, the space between panes is filled with an insulating gas (e.g., a noble gas such as argon, krypton, etc.) which functions as a thermal insulator to reduce heat transfer through transparent unit 16. In other embodiments, the space between panes may be evacuated (e.g., by drawing a vacuum) to provide a layer of thermal insulation between the panes. Spacers may be inserted between adjacent panes of transparent unit 16 to maintain separation between the panes when the vacuum is drawn.

In some embodiments, a coating or laminate layer is applied to one or more panes of transparent unit 16. The coating or laminate layer can be used to keep transparent unit 16 intact if breakage occurs and may prevent the contamination of merchandise in the refrigerated display case in the event that transparent unit 16 is damaged (e.g., by containing glass shards). In some embodiments, the coating or laminate layer functions as an anti-condensate coating and/or an ultraviolet (UV) inhibitor. For example, one or more panes of transparent unit 16 may have an anti-condensate coating (e.g., a pyrolitic coating, a mylar coating, etc.) applied thereto. The anti-condensate coating may be used to prevent condensation from occurring. The anti-condensate coating can be applied by spraying, adhering, laminating, or otherwise depositing the coating (e.g., using chemical vapor deposition or any other suitable technique).

In some embodiments, the anti-condensate coating is an electrically-conductive coating. To provide electricity to the coating, transparent unit 16 may include parallel bus bars (e.g., top and bottom, left and right side, etc.). The bus bars may be spaced apart from one another and adhered to the electrically-conductive coating. Each bus bar may include a lead assembly or solder tab for adhering wires that are in communication with an electrical source. In this arrangement, electric current may pass through one of the lead assemblies, to a first of the bus bars, across the electrically-conductive coating to the second bus bar, and through the other lead assembly. The electric current may cause heat to be generated across transparent unit 16 (e.g., due to electrical resistance of the coating), which may assist in preventing condensation on transparent unit 16. An exemplary bus bar system which may be used in conjunction with transparent unit 16 is described in detail in U.S. Pat. Nos. 6,606,832, and 6,606,833, both of which are incorporated by reference herein in their entireties.

In some embodiments, display case doors 12-13 are configured to maximize visible light transmission from inside the case to the customer, thereby improving the ability of customers to view display items. However, it is also desirable to minimize the transmission of non-visible light (i.e., ultraviolet and infrared light) through transparent unit 16 from outside to inside the case in order to improve thermal performance (e.g., by reducing radiation heat transfer) and to protect items therein. In some embodiments, an anti-reflective coating is be applied to transparent unit 16. The anti-reflective coating may absorb or transmit infrared light, ultraviolet light, or any combination thereof. In some embodiments, the anti-reflective coating may absorb or transmit some frequencies of visible light in addition to infrared and/or ultraviolet light.

In some embodiments, display case doors 12-13 may be configured to use non-visible wavelengths of light to heat transparent unit 16, thereby reducing or preventing condensation. For example, one or more panes of transparent unit 16 may include a UV inhibitor. A UV inhibitor may increase the shelf life of products within the refrigerated display case by preventing ultraviolet light from passing through transparent unit 16. The ultraviolet light may be absorbed or reflected by the UV inhibitor and may be used as a source of energy to heat transparent unit 16. As another example, one or more panes of transparent unit 16 may be treated with a low-emissivity heat-reflective coating to improve overall thermal resistance (e.g., by reducing radiation heat transfer) and/or to prevent external condensation.

Still referring to FIG. 1, display case doors 12-13 are shown to include a rear display case door 12 and a front display case door 13. Display case doors 12-13 may be slightly offset within perimeter frame 14 such that display case doors 12-13 can slide without colliding. For example, display case door 12 may be positioned slightly behind display case door 13. Display case doors 12-13 may slide linearly relative to perimeter frame 14 (i.e., left and right in FIG. 1) to allow consumer access to items stored within the refrigerated display case. In some embodiments, each of display case doors 12-13 slides along a separate track defined by perimeter frame 14. For example, display case door 12 may slide along a rear track within perimeter frame 14, whereas display case door 13 may slide along a front track within perimeter frame 14. Display case doors 12-13 may slide between a closed position (shown in FIG. 1) in which display case doors 12-13 are arranged substantially side-by-side and an open position in which display case doors 12-13 at least partially overlap. In some embodiments, each of display case doors 12-13 include a handle to facilitate sliding the display case door between the closed position and the open position. In other embodiments, display case doors 12-13 do not include handles and can be slid by applying a horizontal force to the side of the door.

Figure 2:
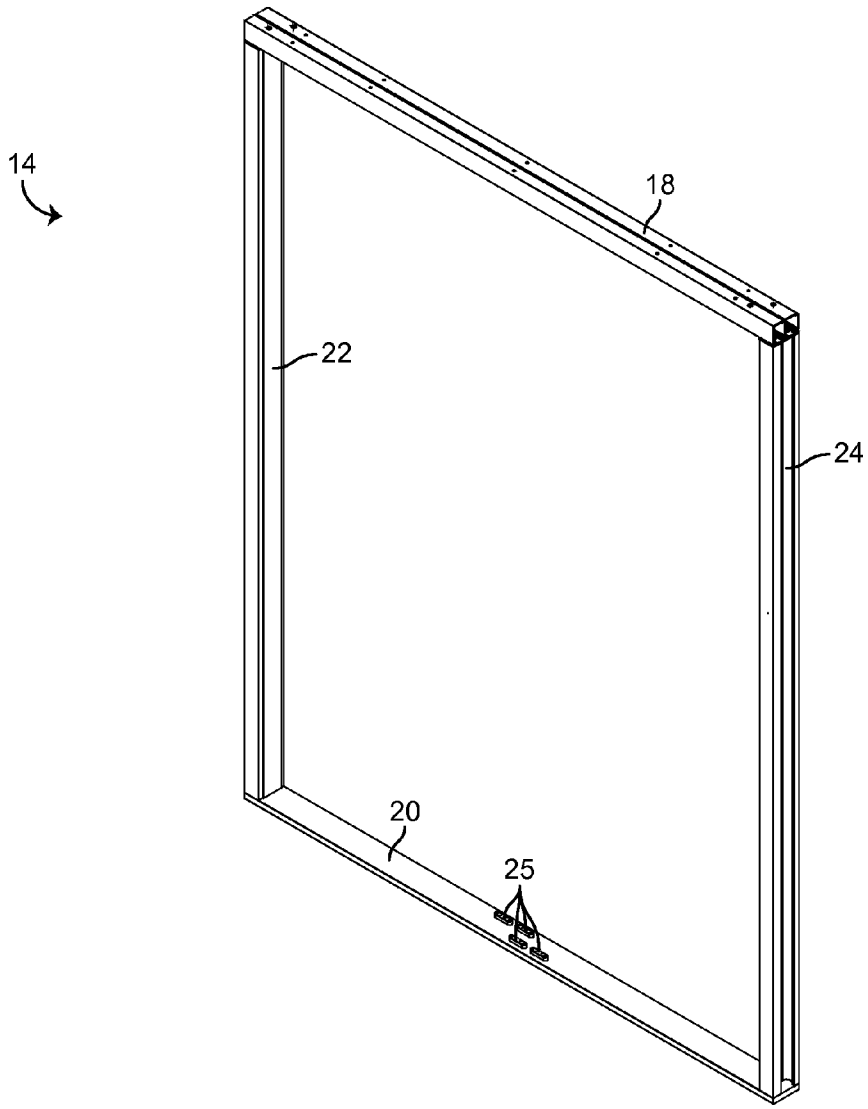
FIG. 2 is a drawing illustrating the perimeter frame of FIG. 1 in greater detail, according to an exemplary embodiment.

Referring now to FIG. 2, perimeter frame 14 is shown without display case doors 12-13, according to an exemplary embodiment. In some embodiments, perimeter frame 14 forms a closed perimeter around display case doors 12-13. For example, perimeter frame 14 is shown to include a top frame segment 18, a bottom frame segment 20, a left frame segment 22, and a right frame segment 24 which form a closed perimeter (e.g., a rectangle) around display case doors 12-13. In some embodiments, perimeter frame 14 includes one or more mullion segments that extend vertically between top frame segment 18 and bottom frame segment 20. Display case doors 12-13 may remain within the closed perimeter defined by perimeter frame 14 in the closed position, in the open position, and when sliding between the closed position and the open position. In some embodiments, perimeter frame 14 has a depth approximately twice the depth of each of display case doors 12-13 to allow rear display case door 12 to be positioned behind front display case door 13 in the open position.

In some embodiments, one or more segments of perimeter frame 14 is an insulated frame segment. An insulated frame segment may be filled with an insulating material (e.g., insulating foam, an insulating gas, etc.) to reduce heat transfer through the frame segment. In some embodiments, perimeter frame 14 is a thermal frame as described in U.S. patent application Ser. No. 14/460,973, filed Aug. 15, 2014, the entirety of which is incorporated by reference herein. For example, one or more segments of perimeter frame 14 may include a vacuum panel configured to inhibit heat transfer through perimeter frame 14.

Figure 3:
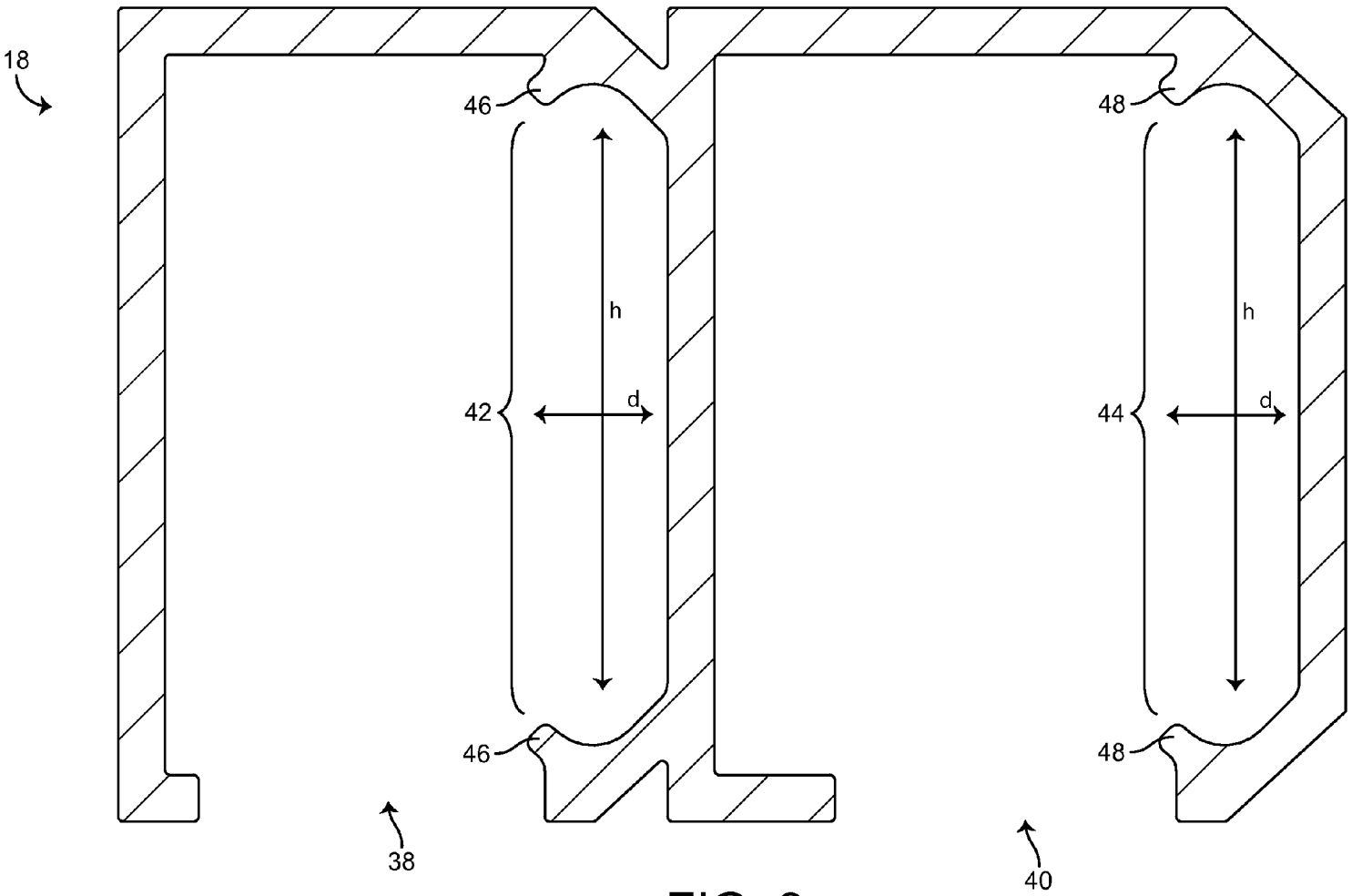
FIG. 3 is a cross-sectional view of a top frame segment of the perimeter frame of FIG. 2, according to an exemplary embodiment.

Referring now to FIG. 3, a cross-section of top frame segment 18 is shown, according to an exemplary embodiment. Top frame segment is shown to include a front channel 38 and a rear channel 40. Channels 38-40 may be parallel or substantially parallel channels which define tracks or paths along which display case doors 12-13 slide between the closed position and the open position. For example, rear display case door 12 may slide along rear channel 40, whereas front display case door 13 may slide along front channel 38.

In some embodiments, display case doors 12-13 are suspended from top frame segment 18. For example, each of display case doors 12-13 may be attached to one or more bearings (e.g., linear bearings, shown in FIGS. 6A-6B) which slide along one of channels 38-40. Advantageously, suspending display case doors 12-13 from top frame segment 18 allows all or substantially all of the weight of display case doors 12-13 to be supported by top frame segment 18, thereby reducing or eliminating any friction force between display case doors 12-13 and bottom frame segment 20. In some embodiments, display case doors 12-13 are suspended from top frame segment 18 such that a gap exists between the bottom of display case doors 12-13 and bottom frame segment 20. The gap may be covered by a seal, wiper, gasket, or the like attached to display case doors 12-13.

Still referring to FIG. 3, front channel 38 is shown to include a front sub-channel 42, and rear channel 40 is shown to include a rear sub-channel 44. The sliding bearings may be secured within sub-channels 42 and 44 by flanges 46 and 48, respectively. In some embodiments, sub-channels 42-44 are arranged vertically. For example, each of sub-channels 42-44 is shown having a height h which exceeds its depth d.

Advantageously, the vertical arrangement of sub-channels 42-44 reduces the total depth of top frame segment 18 (i.e., left to right in FIG. 3) and results in a more compact configuration of components.

Figure 4:
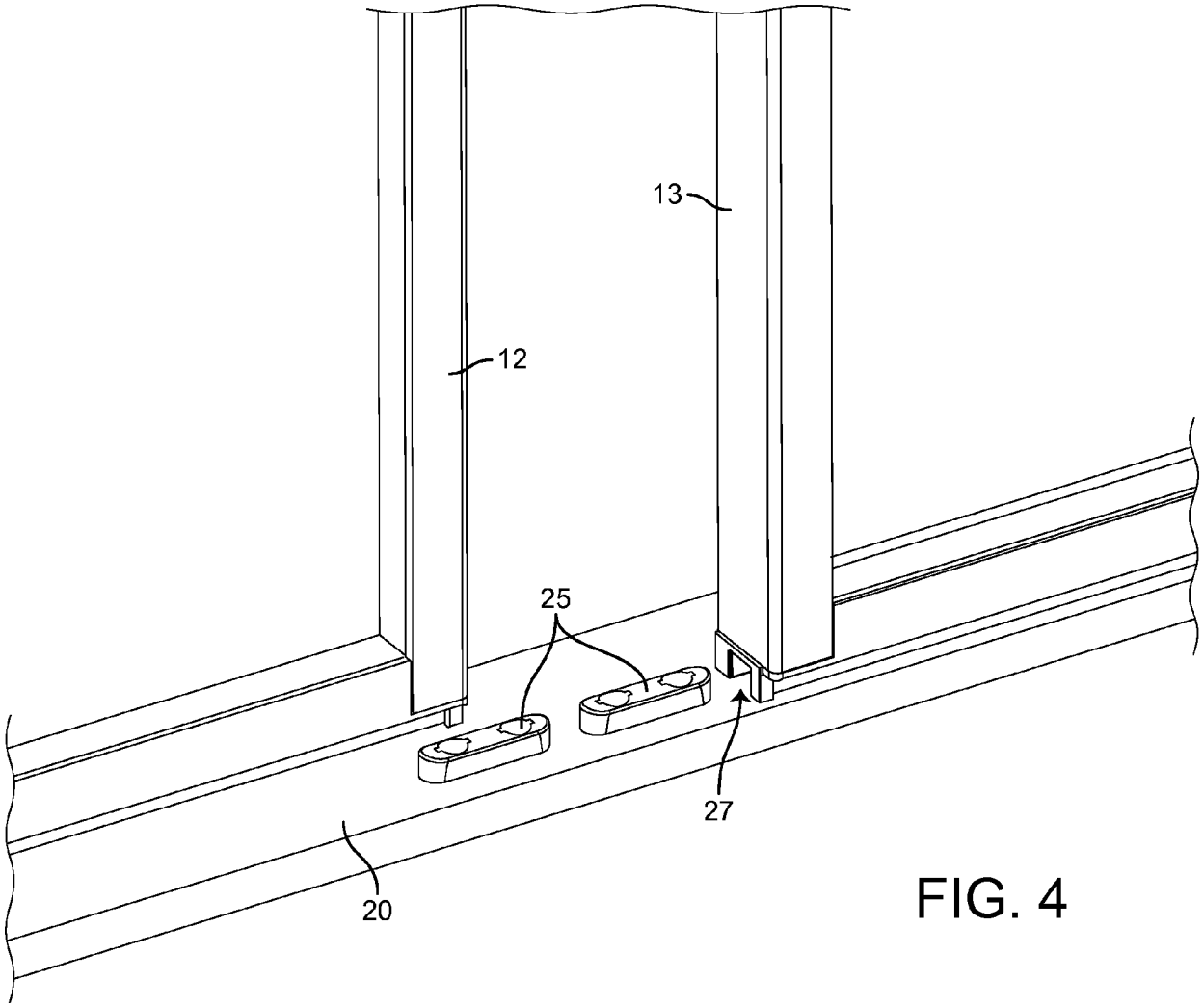
FIG. 4 is a drawing of a lower portion of the sliding door assembly of FIG. 1, illustrating a gutterless bottom frame segment of the perimeter frame with guides that facilitate sliding of the display case doors, according to an exemplary embodiment.

Referring now to FIG. 4, bottom frame segment 20 is shown to include a plurality of guides 25. The upper surface of bottom frame segment 20 may be flat or substantially flat with guides 25 extending upward therefrom. Guides 25 may be configured to fit within a channel 27 along a bottom surface of display case doors 12-13 and may constrain the movement of each display case door to a linear path defined by guides 25. The flat upper surface of bottom frame segment 20 results in a bottom frame segment 20 that is completely gutterless (i.e., without a track, channel, or gutter within bottom frame segment 20). Advantageously, the gutterless design of bottom frame segment 20 facilitates cleaning and prevents bottom frame segment 20 from collecting debris which could interfere with the sliding of display case doors 12-13.

Figure 5:
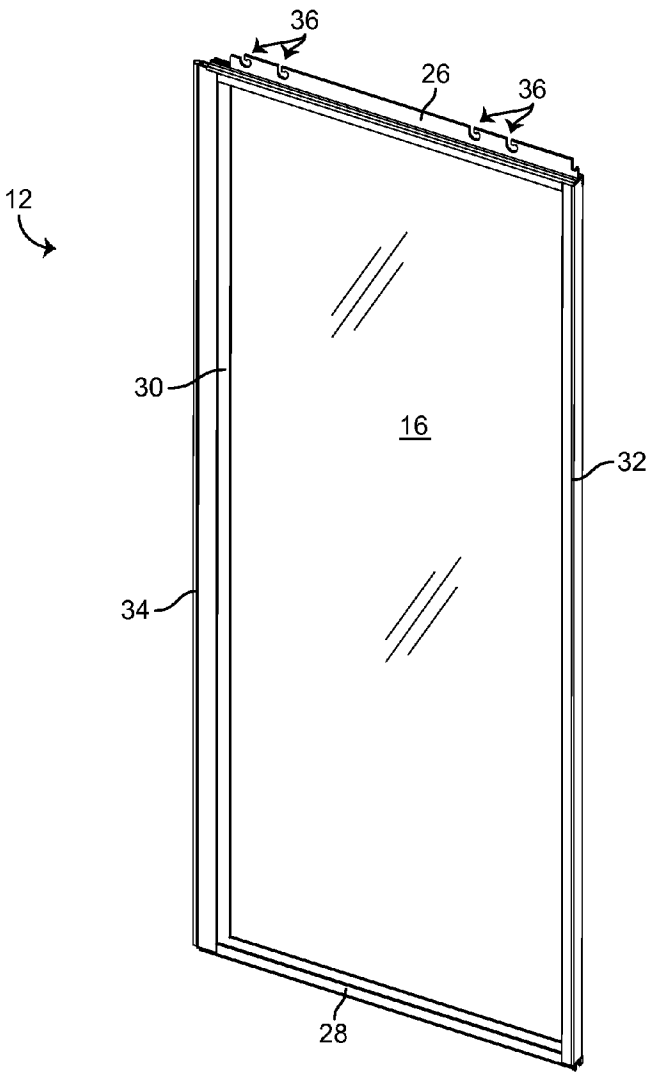
FIG. 5 is a drawing illustrating one of the display case doors of FIG. 1 in greater detail, according to an exemplary embodiment.

Referring now to FIG. 5, display case door 12 is shown in isolation, according to an exemplary embodiment. Display case door 12 is shown to include transparent unit 16 contained within a perimeter formed by a suspension frame segment 26 (i.e., a top frame segment), a bottom frame segment 28, a left frame segment 30, and a right frame segment 32. Suspension frame segment 26 may be configured to attach to one or more sliding bearings (shown in FIGS. 6A-6B) which slide along a channel within top frame segment 18 of perimeter frame 14. For example, suspension frame segment 26 is shown to include a plurality of hooks 36 which allow suspension frame segment 26 to be hung from the sliding bearings. In some embodiments, all or substantially all of the weight of display case door 12 may be supported by suspension frame segment 26 via hooks 36.

In some embodiments, one or more of frame segments 26-32 include an edge guard (e.g., a seal, a wiper, a gasket, etc.) which provides a sealing feature for display case door 12. For example, frame segment 30 of display case door 12 is shown to include an edge guard 34 which contacts frame segment 22 of perimeter frame 14 when display case door 12 is closed. In some embodiments, edge guard 34 employs a flexible bellows and magnet arrangement. Bottom frame segment 28 of display case door 12 may include a seal which engages bottom frame segment 20 of perimeter frame 14 to provide a sealing feature along the bottom of display case door 12. In some embodiments, frame segment 32 of display case door 12 includes an edge guard (e.g., a wiper) which cooperates with a corresponding edge guard on display case door 13 to provide a sealing feature when display case doors 12-13 are closed. Although only display case door 12 is shown in FIG. 5, it is understood that display case door 13 may include the same or similar features.

Figure 6A:
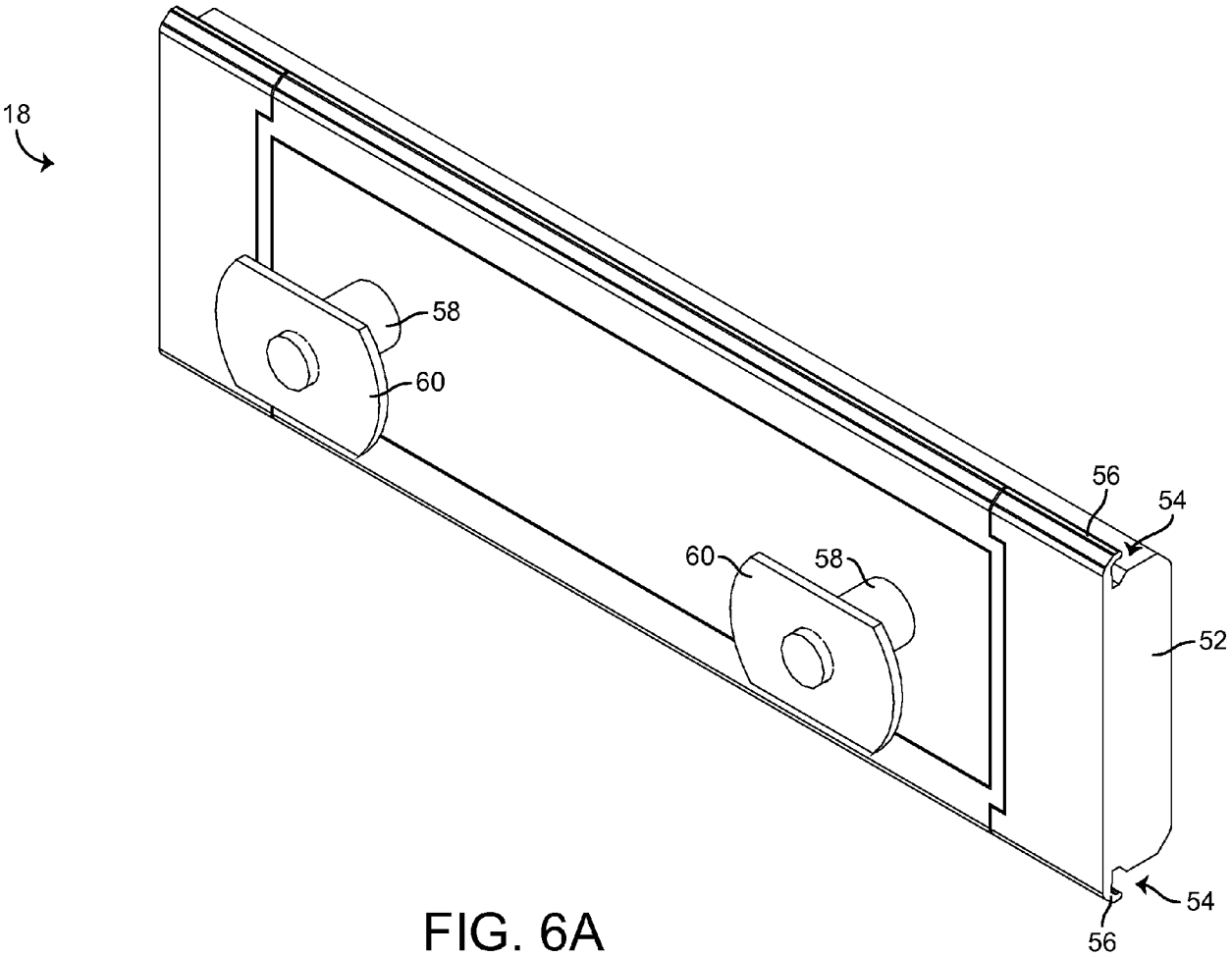
FIGS. 6A-6B are drawings of a sliding bearing configured to slide within the top frame segment of FIG. 3, according to an exemplary embodiment.
Figure 6B:
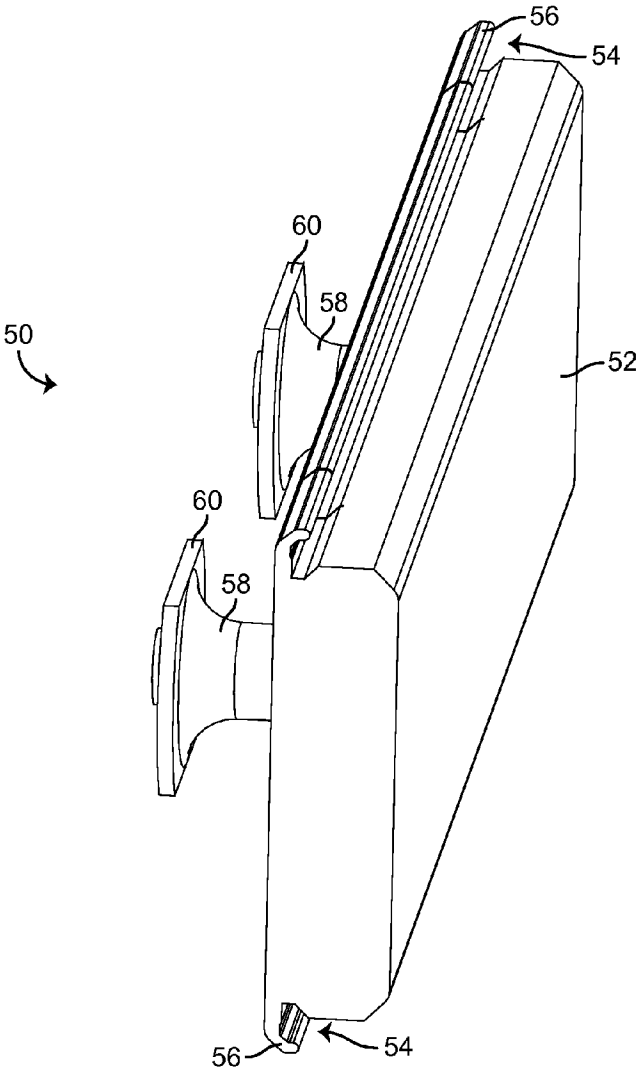

Referring now to FIGS. 6A-6B, a sliding bearing 50 is shown, according to an exemplary embodiment. Sliding bearing 50 may be configured to provide guidance, movement, and/or positioning for display case doors 12-13. Sliding bearing 50 is shown to include a body 52, flanges 56, and grooves 54 defined between body 52 and flanges 56. One or more sliding bearings 50 may be positioned within channels 38-40 of top frame segment 18 and may be configured to slide along channels 38-40. For example, body 52 may be configured to fit within sub-channels 42-44 and may slide along one of sub-channels 42-44. In some embodiments, body 52 includes a recirculating ball carriage around a perimeter of body 52. The recirculating ball carriage may contain ball bearings (e.g., stainless steel ball bearings, polymer ball bearings, etc.) that facilitate sliding of sliding bearing 50 along sub-channels 42-44. Grooves 54 may be configured to receive flanges 46-48 of top frame segment 18 to secure sliding bearing 50 within sub-channel 42 or 44.

Sliding bearing 50 may be configured to attach to display case doors 12-13. For example, sliding bearing 50 is shown to include multiple posts 58 extending from body 52. When sliding bearing 50 is positioned within sub-channels 42-44, posts 58 may be oriented horizontally or substantially horizontally. Display case doors 12-13 may be hung from posts 58 via hooks 36. Sliding bearing 50 may support the weight of display case doors 12-13 (e.g., via posts 58 and hooks 36) such that display case doors 12-13 are suspended from top frame segment 18. In some embodiments, posts 58 include caps 60 at ends thereof. In various embodiments, caps 60 may be fasteners (e.g., threaded nuts) attached to ends of posts 58 or may be part of a unitary component that includes posts 58 and caps 60. Posts 58 may extend substantially horizontally between caps 60 and body 52. In some embodiments, posts 58 include a narrow end proximate to body 52 and a wide end proximate to caps 60. For example, posts 58 may increase in diameter or thickness as posts 58 extend outward from body 52.

Figure 7A:
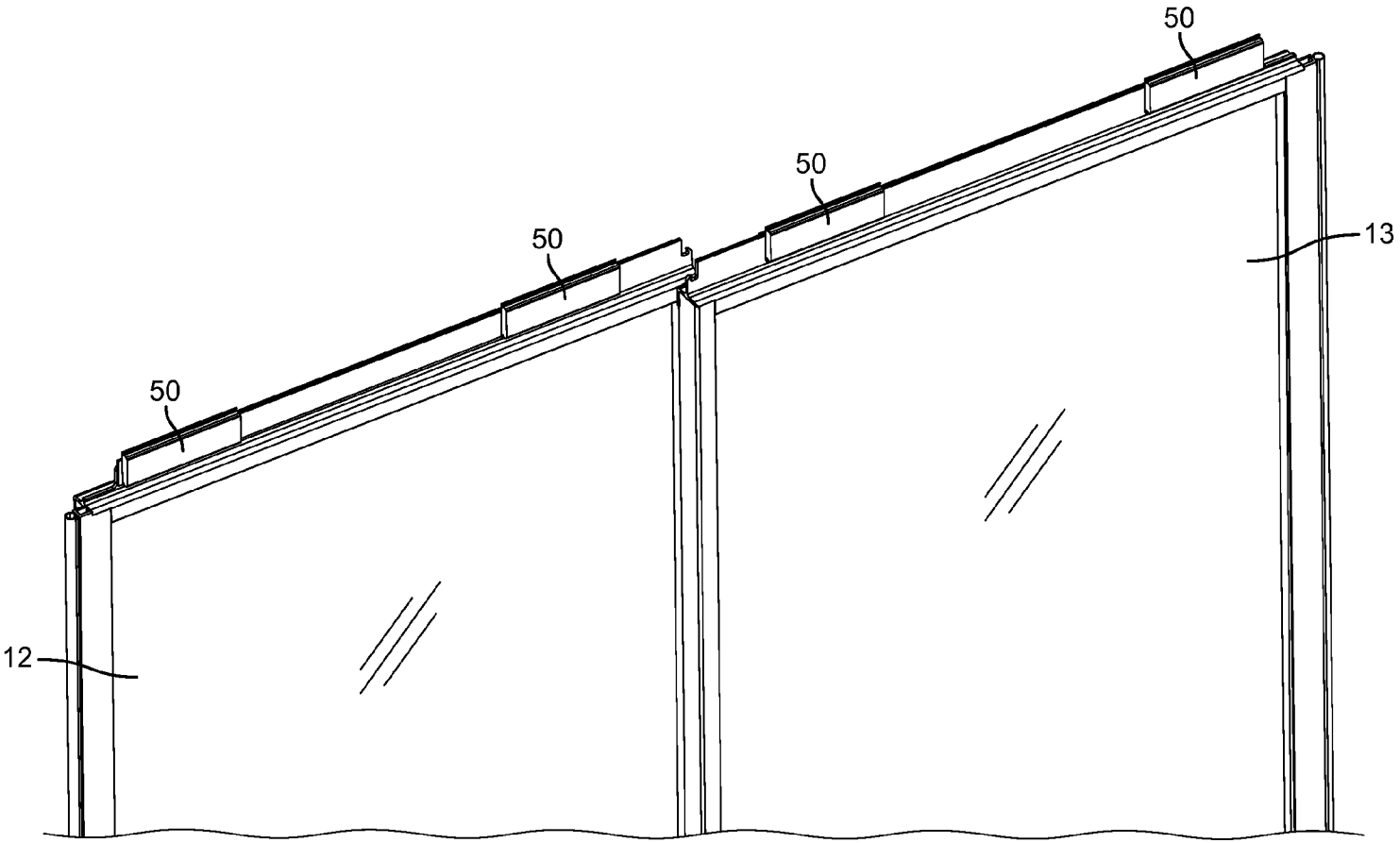
FIGS. 7A-7B are drawings illustrating several of the sliding bearing of FIGS. 6A-6B coupled to the display case doors to facilitate suspending the display case doors within channels of the top frame segment of FIG. 3, according to an exemplary embodiment.
Figure 7B:
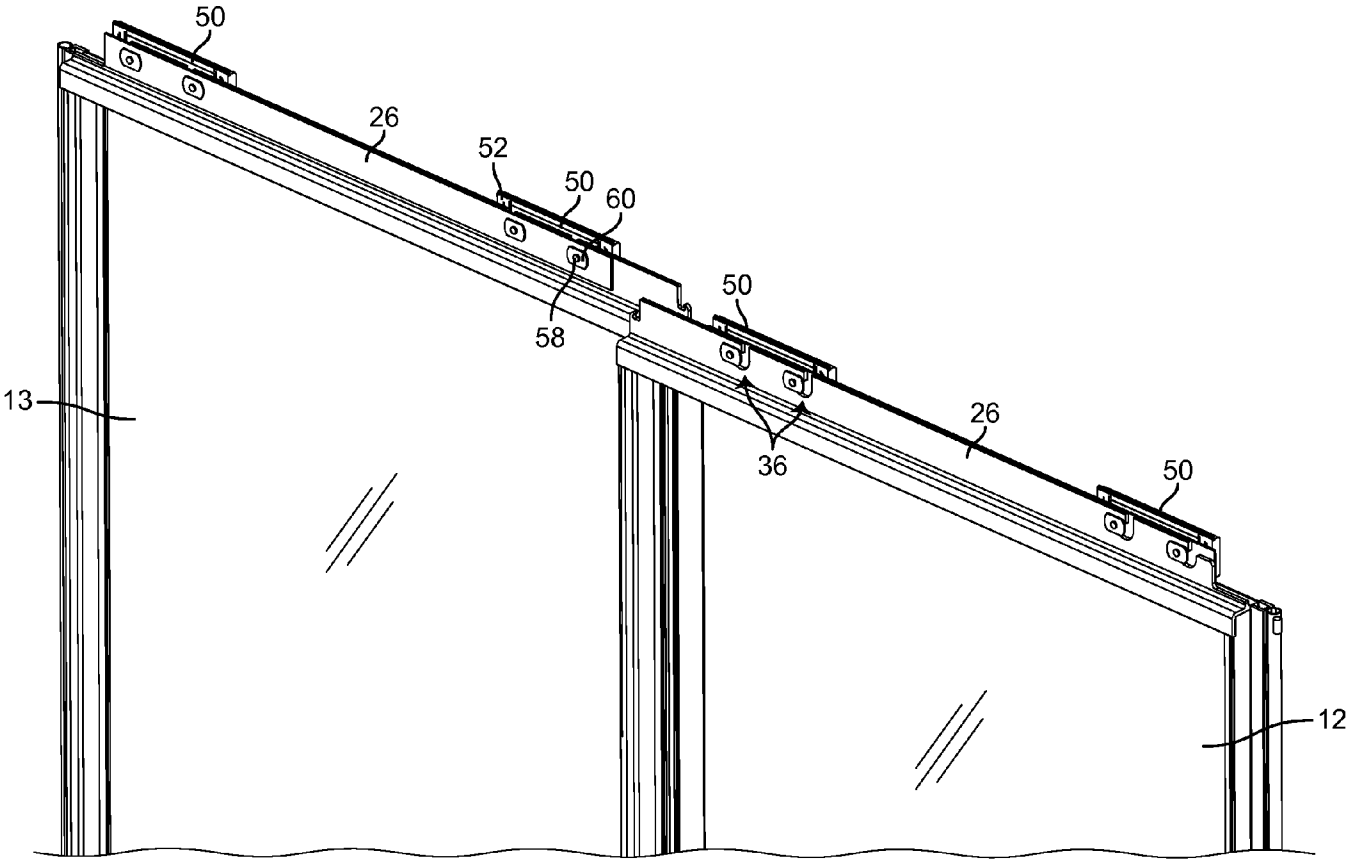

Referring now to FIGS. 7A-7B, a plurality of sliding bearings 50 are shown attached to display case doors 12-13, according to an exemplary embodiment. Display case doors 12-13 may be hung from sliding bearings 50 via suspension frame segment 26. For example, posts 58 may be inserted into hooks 36 such that posts 58 extend through suspension frame segment 26 (i.e., with body 52 on one side of suspension frame segment 26 and caps 60 on the other side of suspension frame segment 26). During installation, sliding bearings 50 may be inserted into top frame segment 18 prior to hanging display case doors 12-13. The open top configuration of hooks 36 allows display case doors 12-13 to be moved into position under top frame segment 18 and then lifted and hung on posts 58.

Figure 8:
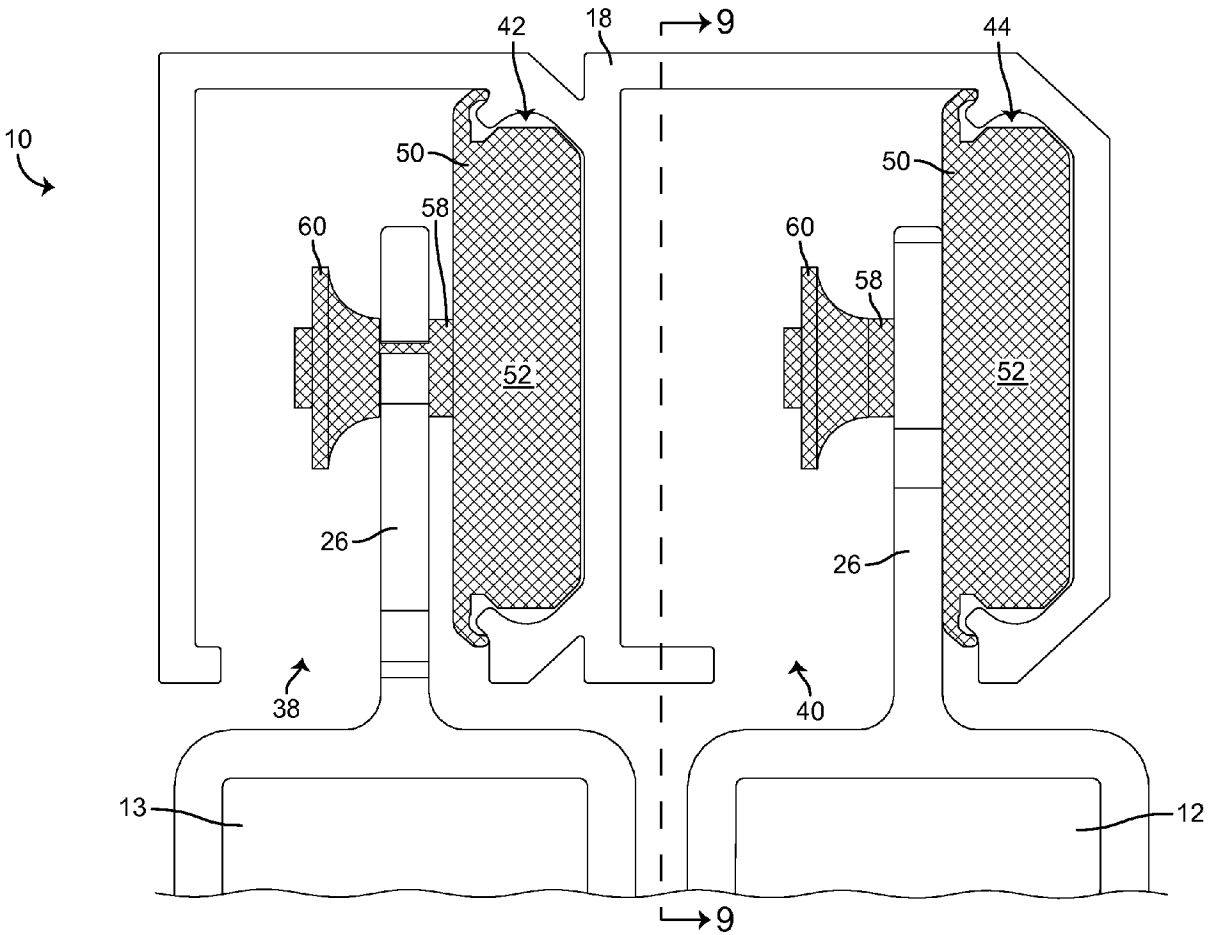
FIG. 8 is a side elevation view of the sliding bearings within channels of the top frame segment of FIG. 3 and the display case doors hanging on posts that extend horizontally from the sliding bearings, according to an exemplary embodiment.

Referring now to FIG. 8, a side elevation view of sliding door assembly 10 is shown, according to an exemplary embodiment. In FIG. 8, sliding bearings 50 are shaded for clarity and are disposed within sub-channels 42-44. Display case doors 12-13 are hung from posts 58 (via suspension frame segment 26 and hooks 36) such that body 52 is disposed on one side of suspension frame segment 26 and caps 60 are disposed on the opposite side of suspension frame segment 26. Posts 58 extend horizontally between body 52 and caps 60, through suspension frame segment 26. Sliding bearings 50 can slide along sub-channels 42-44 to allow display case doors 12-13 to move between the open position and the closed position.

Figure 9A:
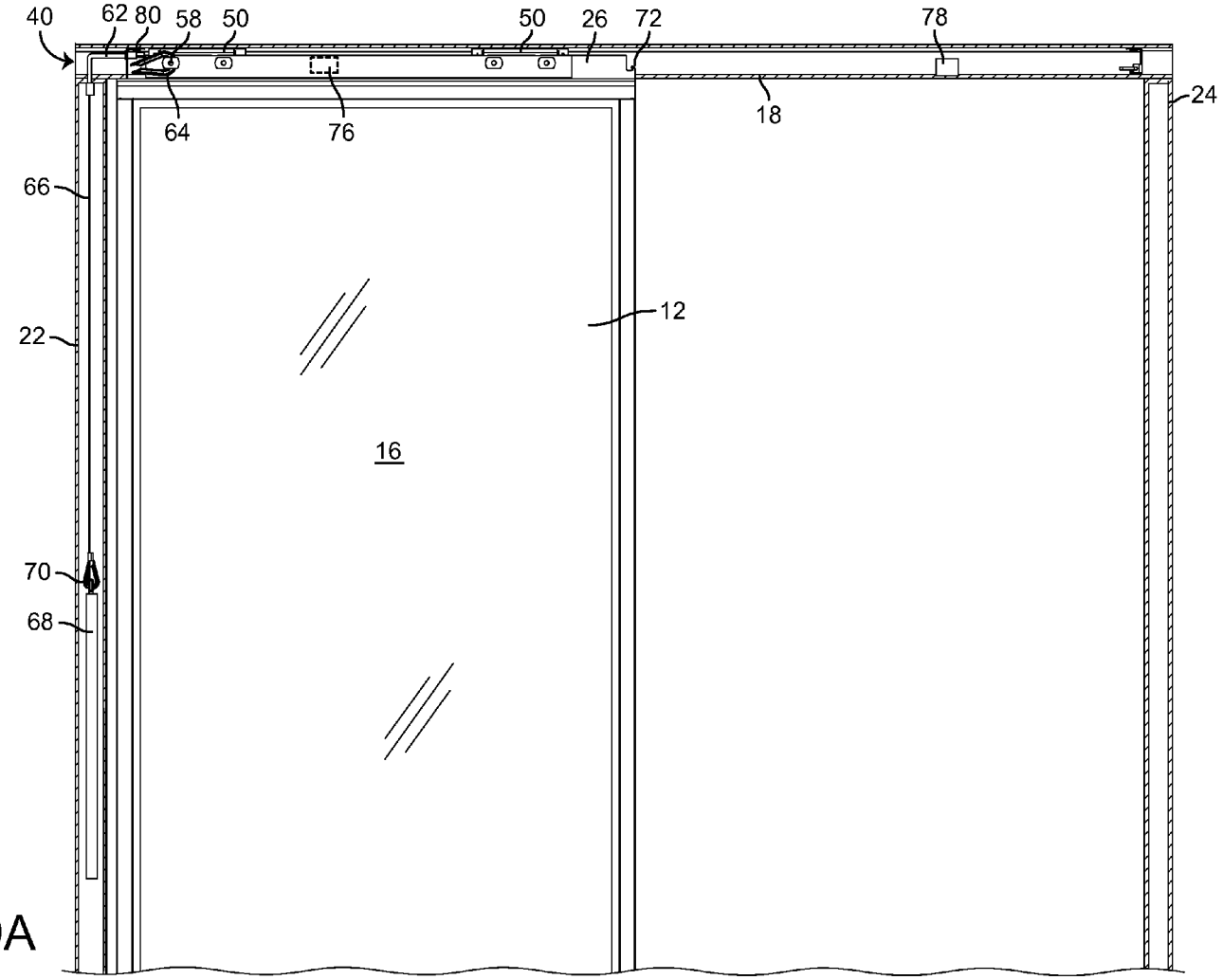
FIG. 9A is a front cross-sectional elevation view of the sliding door assembly of FIG. 1 taken along the line 9-9 in FIG. 8, according to an exemplary embodiment.
Figure 9B:
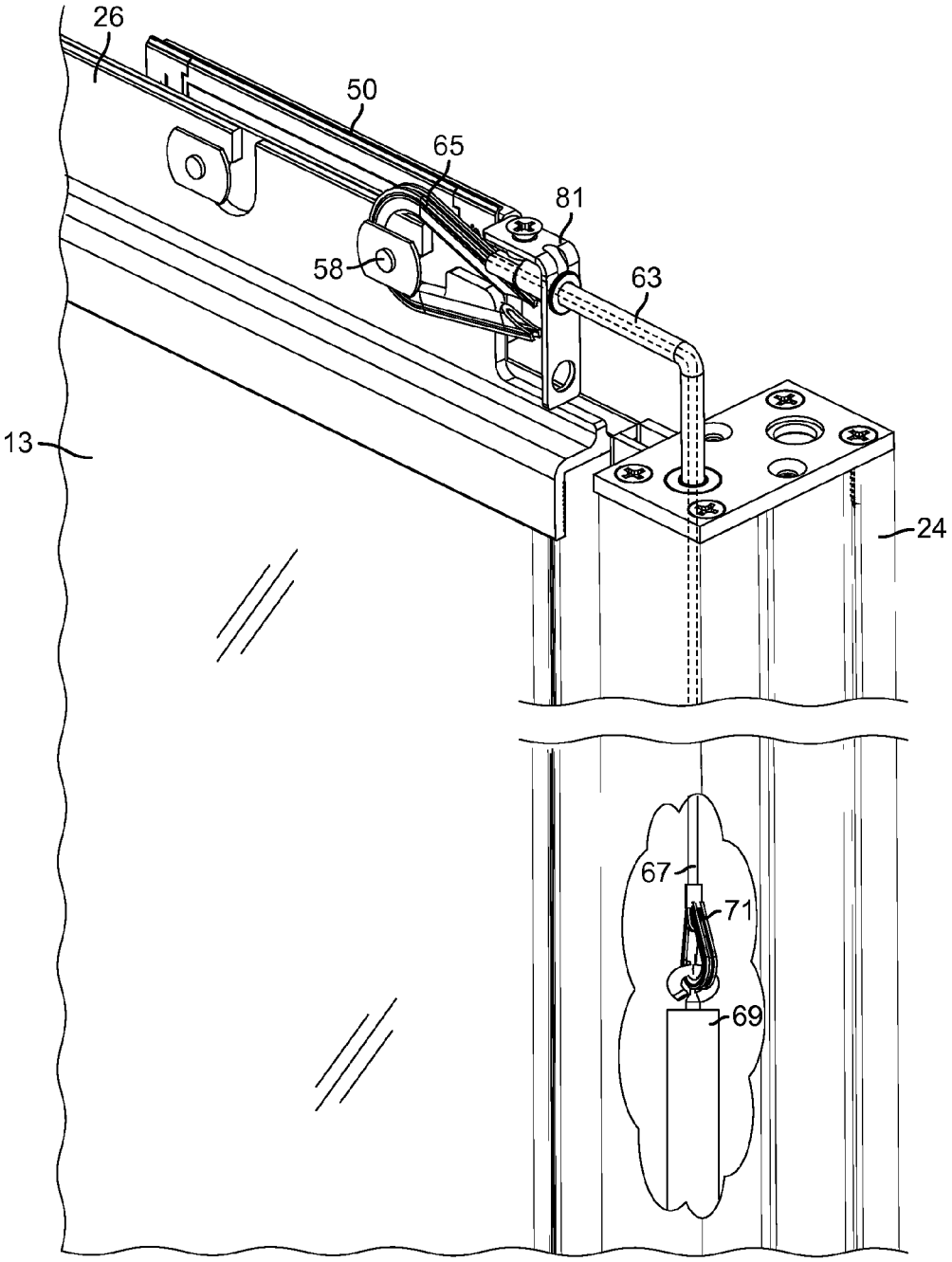
FIG. 9B is a perspective view of a portion of the sliding door assembly of FIG. 1 with the top frame segment removed, according to an exemplary embodiment.

Referring now to FIGS. 9A-9B, a weight system for automatically closing display case doors 12-13 is shown, according to an exemplary embodiment. The weight system may be configured to bias display case doors 12-13 toward the closed position and may be referred to as a biasing system, a weight system, an automatic closure system, or the like. Advantageously, the weight system may be configured to automatically cause display case doors 12-13 to return to the closed position when display case doors 12-13 are not held open.

Referring particularly to FIG. 9A, a front cross-sectional elevation view of sliding door assembly 10 taken along the line 9-9 in FIG. 8 is shown, according to an exemplary embodiment. As shown in FIG. 9A, a weight 68 may be suspended within left frame segment 22 by a cable 66. Cable 66 may be attached to weight 68 by a cable loop 70. Cable 66 may extend upward from weight 68 and into housing 62.

Housing 62 is shown as an "L-shaped" conduit which bends by approximately 90 degrees. In some embodiments, housing 62 passes through a bottom surface of channel 40 and is supported by a bracket 80 attached to a top surface of channel 40. Housing 62 may act as a pulley for cable 66 and redirect cable 66 substantially horizontally.

Cable 66 may extend horizontally from housing 62 and attach to display case door 12. In some embodiments, cable 66 wraps around one of posts 58 via a cable loop 64. When display case door 12 is opened (i.e., moved to the right in FIG. 9), the movement of display case door 12 may cause the top end of cable 66 to be pulled horizontally (e.g., to the right) along with display case door 12. As the top end of cable 66 is pulled by display case door 12, cable 66 may be pulled at least partially through housing 62, thereby lifting weight 68. When display case door 12 is released, the weight of weight 68 may cause cable 66 to pull display case door 12 toward the closed position.

Referring particularly to FIG. 9B, a perspective view of a portion of sliding door assembly 10 is shown with top frame segment 18 removed, according to an exemplary embodiment. As shown in FIG. 9B, another weight 69 may be suspended within right frame segment 24 by a cable 67. Cable 67 may be attached to weight 69 by a cable loop 71. Cable 67 may extend upward from weight 69 and into housing 63. Housing 63 is shown as an "L-shaped" channel which bends by approximately 90 degrees. In some embodiments, housing 63 passes through a bottom surface of channel 38 and is supported by a bracket 81 attached to a top surface of channel 38. Housing 63 may act as a pulley for cable 67 and redirect cable 67 substantially horizontally.

Cable 67 may extend horizontally from housing 63 and attach to display case door 13. In some embodiments, cable 67 wraps around one of posts 58 via a cable loop 65. When display case door 13 is opened, the movement of display case door 13 may cause the top end of cable 67 to be pulled horizontally along with display case door 13. As the top end of cable 67 is pulled by display case door 13, cable 67 may be pulled at least partially through housing 63, thereby lifting weight 69. When display case door 13 is released, the weight of weight 69 may cause cable 67 to pull display case door 13 toward the closed position.

Referring again to FIG. 9A, display case door 12 is shown to include a hook 72. Hook 72 may be disposed at an end of suspension frame segment 26. Top frame segment 18 is shown to include a latch 74 (e.g., a clasp, a lock, a fastener, etc.), a secured to an inner surface of channel 40. When display case door 12 is moved into the open position, latch 74 may engage hook 72. Latch 74 may provide a holding force sufficient to counteract the closing force provided by weight 68, thereby holding display case door 12 in the open position. In some embodiments, the geometry of latch 74 and hook 72 is designed to provide a holding force that corresponds to the weight of weight 68. For example, hook 72 may be angled, curved, or otherwise configured such that the known closing force provided by weight 68 is slightly less than the force required to cause hook 72 to disengage from latch 74. A user can provide a minimal amount of additional closing force to cause hook 72 to disengage from latch 74. Once disengaged, the closing force provided by weight 68 may cause display case door 12 to automatically return to the closed position. A similar hook and latch arrangement may be provided for display case door 13.

Figure 10A:
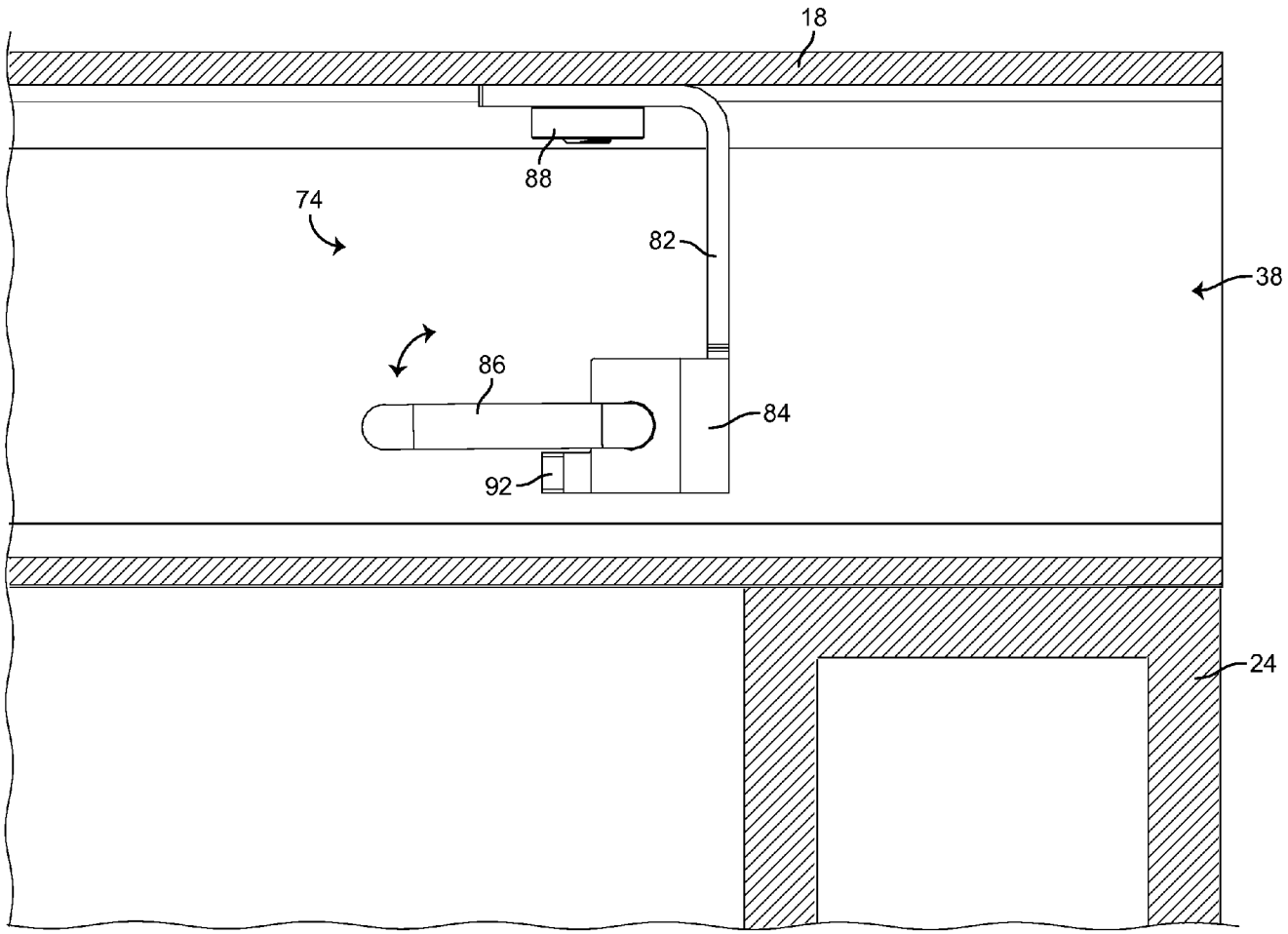
FIG. 10A is a detailed view of the area designated "Detail 10A" in FIG. 9, according to an exemplary embodiment.
Figure 10B:
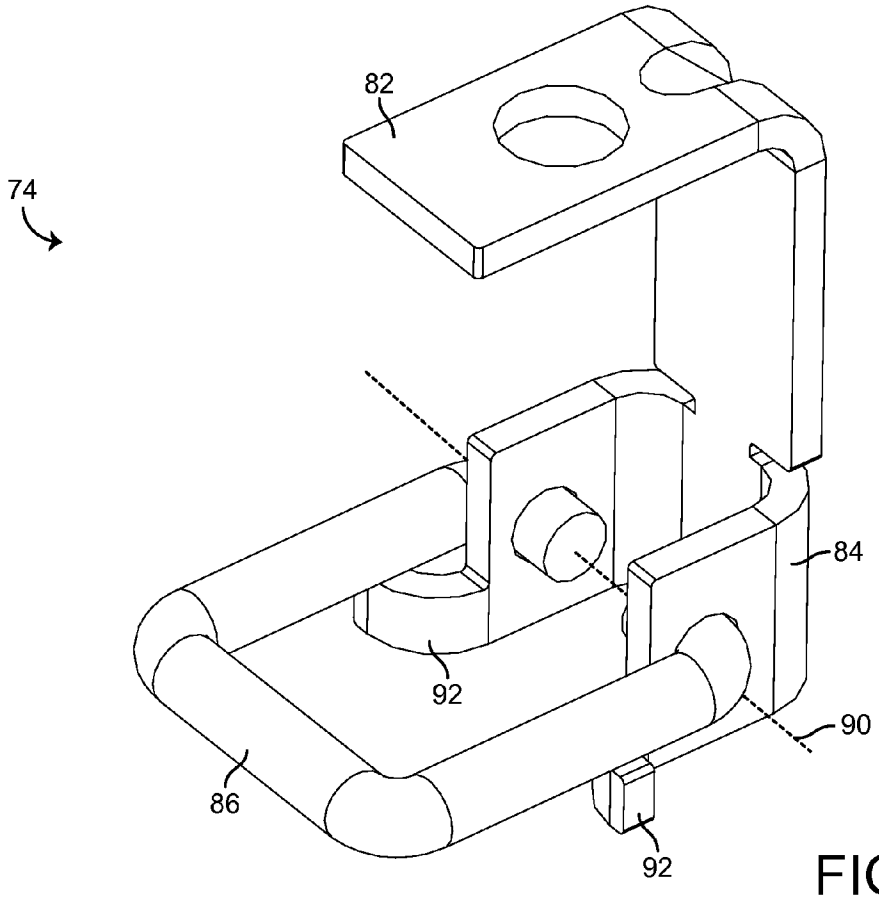
FIG. 10B is a perspective view of a latch which may be used to hold the display case doors in an open position, according to an exemplary embodiment.

Referring now to FIGS. 10A-10B, latch 74 is shown in greater detail, according to an exemplary embodiment. FIG. 10A is a detailed view of the area designated "Detail 10A" in FIG. 9. FIG. 10B is a perspective view of latch 74 in isolation. In FIG. 10A, latch 74 is shown suspended from an upper surface of channel 40 proximate to right frame segment 24. Latch 74 is shown facing toward display case door 12 (i.e., toward the left in FIG. 10A) and may be configured to engage the hook 72 on the end of the suspension frame segment 26 attached to display case door 12. Another latch 75 (shown in FIG. 12) may be suspended from an upper surface of channel 38 proximate to left frame segment 22 in a similar manner. Latch 75 may face toward display case door 13 (i.e., toward the right in FIG. 10A) and may be configured to engage the hook 72 on the end of the suspension frame segment 26 attached to display case door 13.

Latch 74 is shown to include a mounting bracket 82, a body 84, and a swing bar 86. Mounting bracket 82 may be secured to an upper surface of top frame segment 18 (e.g., within channel 38 or 40) via a fastener 88. Body 84 is connected to mounting bracket 82 and is pivotally connected to swing bar 86. Swing bar 86 may pivot about an axis 90 that extends through body 84. In some embodiments, swing bar 86 rests upon supports 92 that extend outward from body 84. Supports 92 may maintain swing bar 86 in a substantially horizontal position when disengaged from hook 72. When hook 72 engages latch 74, swing bar 86 may rotate upward (e.g., clockwise in FIG. 10A) and over the top of hook 72. Swing bar 86 may then rest in a recess between hook 72 and suspension frame segment 26 to hold display case door 12 and/or 13 in the open position.

Referring again to FIG. 9A, display case door assembly 10 is shown to include magnets 76-78. Magnets 76-78 may be rare earth magnets and may be fixed to top frame segment 18. Magnets 76-78 may be configured (e.g., positioned, oriented, shaped, sized, etc.) to interact with a moving portion of display case doors 12-13 and/or sliding bearings 50. For example, sliding bearings 50 may include a magnetic material (e.g., iron, steel, etc.) that is attracted to magnets 76-78. When sliding bearings 50 move past magnets 76-78, the magnetic force between magnets 76-78 and sliding bearings 50 may dampen the movement of display case doors 12-13.

In some instances, magnets 76-78 cause display case doors 12-13 to slow down. For example, magnet 76 may be configured to dampen the movement of display case door 12 as display case door 12 approaches the closed position. Advantageously, the damping provided by magnet 76 counteracts the closing force provided by weight 68 and causes display case door 12 to slow down shortly before reaching the closed position, thereby facilitating a soft closure of display case door 12. Magnet 78 may provide a similar damping effect for display case door 13.

In other instances, magnets 76-78 may hold display case doors 12-13 in the open position. For example, magnet 78 may be configured to align with one of sliding bearings 50 attached to display case door 12 when display case door 12 is in the open position. The magnetic force between magnet 78 and the sliding bearing 50 attached to display case door 12 may assist in holding display case door 12 in the open position. In various embodiments, the magnetic holding force may supplement or replace the physical holding force provided by hook 72 and latch 74. Magnet 76 may provide a similar holding force for display case door 13.

Advantageously, each of magnets 76-78 may be configured to magnetically engage (i.e., attract via magnetic force) multiple different sliding bearings 50. For example, magnet 78 may engage a sliding bearing 50 attached to display case door 12 to hold display case door 12 in the open position, and may engage a sliding bearing 50 attached to display case door 13 to dampen the closing of display case door 13.

Similarly, magnet 76 may engage a sliding bearing 50 attached to display case door 13 to hold display case door 13 in the open position, and may engage a sliding bearing 50 attached to display case door 12 to dampen the closing of display case door 12. In this configuration, each of magnets 76-78 may provide a holding force to one of display case doors 12-13 and a damping force to the other of display case doors 12-13.

Figure 11:
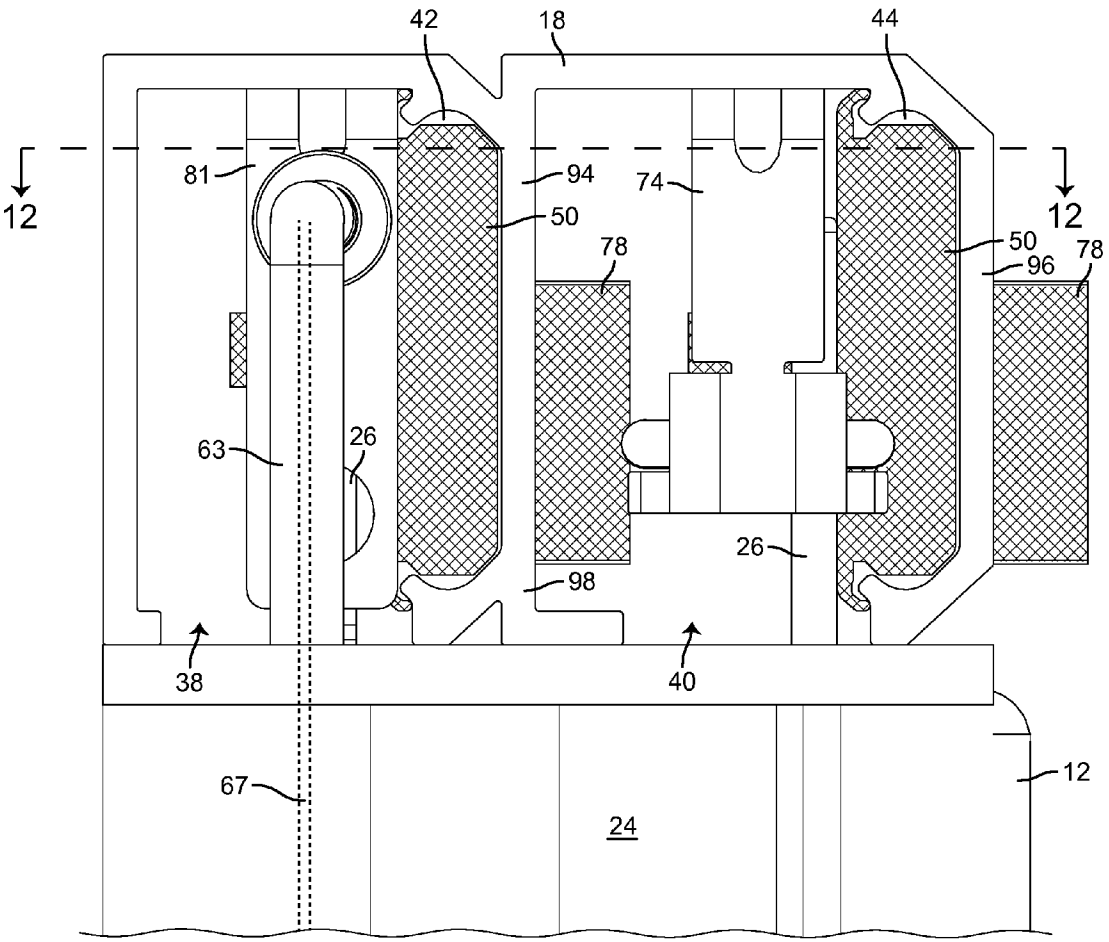
FIG. 11 is a right side elevation view of the sliding door assembly of FIG. 1, according to an exemplary embodiment.

Referring now to FIG. 11, a right side elevation view of sliding door assembly 10 is shown, according to an exemplary embodiment. In FIG. 11, sliding bearings 50 and magnets 78 are shaded for clarity. Sliding bearings 50 are shown within sub-channels 42-44. Magnets 78 may be attached to surfaces 94 and/or 96 of top frame segment 18 and configured to magnetically engage sliding bearings 50 through top frame segment 18. Latch 74 is suspended from a top surface of rear channel 40 and bracket 81 is suspended from a top surface of front channel 38. Cable 67 extends vertically within housing 63 and connects to weight 69 suspended within right frame segment 24. It is understood that the components shown in FIG. 11 may be duplicated on the left side of top frame segment 18, in opposite channels 38-40, as shown in FIG. 12.

Figure 12:
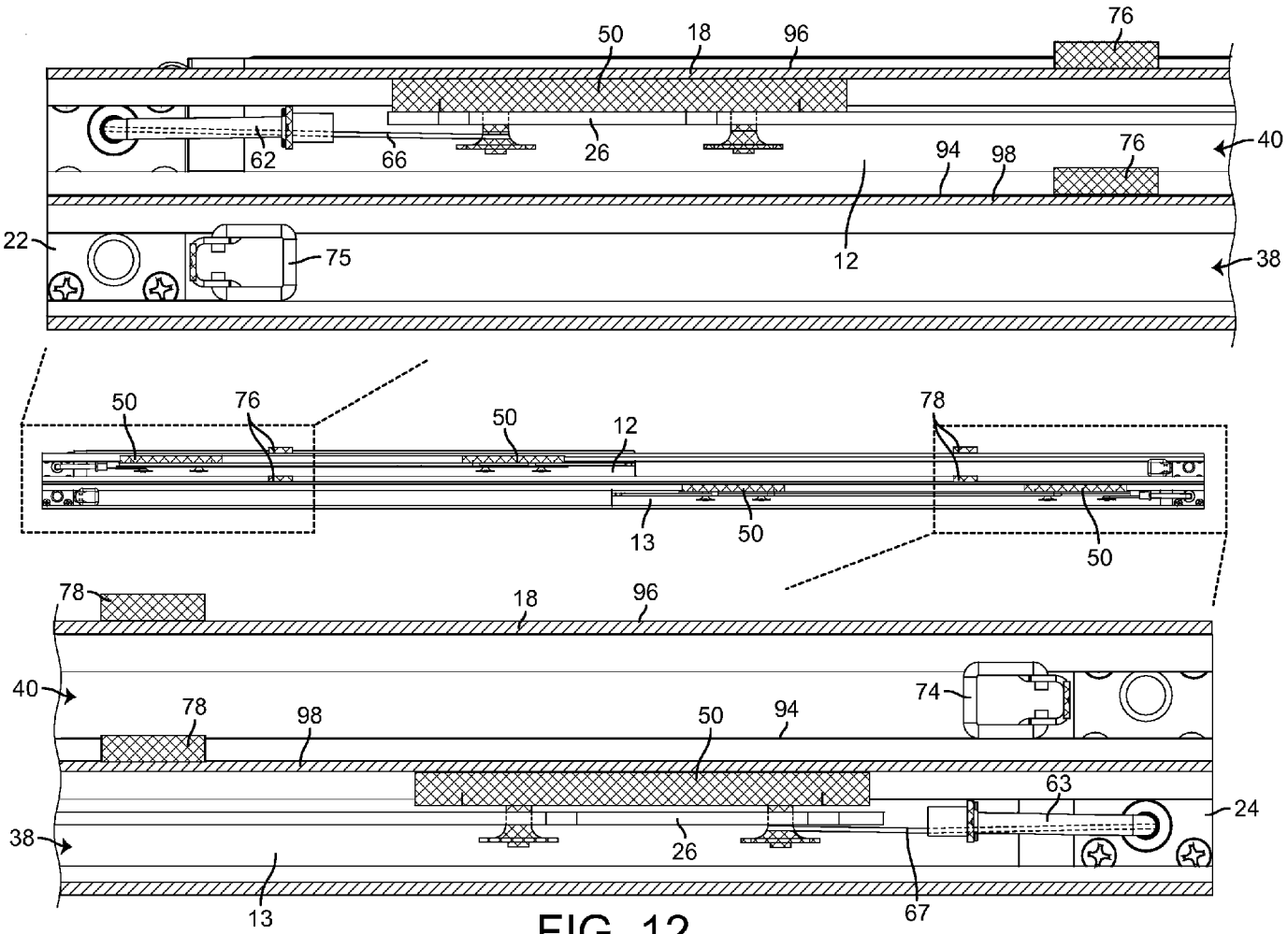
FIG. 12, a cross-sectional plan view of the sliding door assembly of FIG. 1 taken along the line 12-12 in FIG. 11, according to an exemplary embodiment.

Referring now to FIG. 12, a cross-sectional plan view of sliding door assembly 10 is shown, according to an exemplary embodiment. The cross-section shown in FIG. 12 is taken along the line 12-12 shown in FIG. 11 with display case doors 12-13 in the closed position. Top frame segment 18 is shown to include a center wall 98 separating front channel 38 and rear channel 40. Center wall 98 may be a vertical or substantially vertical wall disposed approximately halfway between the front surface of top frame segment 18 and the rear surface of top frame segment 18. Center wall 98 may be a shared boundary for channels 38-40. In some embodiments, one or more of magnets 76-78 is attached to a rear surface 94 of center wall 98 and/or to a rear surface 96 of top frame segment 18.

In the embodiment shown in FIG. 12, magnets 76-78 are each shown to include two magnets (i.e., two of magnets 76 and two of magnets 78). One of magnets 76 and one of magnets 78 may be attached to surface 94, whereas the other of magnets 76 and magnets 78 may be attached to surface 96. However, it should be understood that in other embodiments, magnets 76-78 may each include only a single magnet. For example, magnet 76 may be attached only to surface 96 and magnet 78 may be attached only to surface 94, or vice versa. In further embodiments, one or more additional magnets may be provided at various locations along top frame segment 18 to provide a damping force and/or holding force for display case doors 12-13.

As shown in FIG. 12, front display case door 13 may slide within front channel 38 between the closed position and the open position. Sliding front display case door 13 into the open position may include moving display case door 13 horizontally (i.e., to the left in FIG. 12) until hook 36 on the end of suspension frame segment 26 engages latch 75. As front display case door 13 moves into the open position, cable 67 may be pulled at least partially out of housing 63, causing weight 69 to be lifted within right frame segment 24. Latch 75 may cooperate with hook 36 to hold front display case door 13 in the open position. In some embodiments, one or more of magnets 76 magnetically engage a sliding bearing 50 coupled to front display case door 13 when front display case door 13 is in the open position. The magnetic force between magnets 76 and sliding bearing 50 may assist with holding front display case door 13 in the open position. In some embodiments, magnets 76 are configured to apply a magnetic force sufficient to hold display case door 13 in the open position with or without assistance from latch 75.

Front display case door 13 may disengage magnets 76 and/or latch 75 to begin sliding toward the closed position (i.e., to the right in FIG. 12). Weight 69 may apply a downward force to the bottom of cable 67, which is translated into a horizontal force as cable 67 bends within housing 63. The horizontal force may be transmitted through cable 67 and applied to display case door 13 (e.g., via sliding bearing 50 and/or suspension frame segment 26). The horizontal force causes display case door 13 to automatically slide toward the closed position. As front display case door 13 approaches the closed position, one or more of magnets 78 may engage a sliding bearing 50 coupled to front display case door 13. The magnetic force between magnets 78 and sliding bearing 50 may dampen the movement of front display case door 13, thereby facilitating a soft closure of front display case door 13.

Similarly, rear display case door 12 may slide within rear channel 40 between the closed position and the open position. Sliding rear display case door 12 into the open position may include moving display case door 12 horizontally (i.e., to the right in FIG. 12) until hook 36 on the end of suspension frame segment 26 engages latch 74. As rear display case door 12 moves into the open position, cable 66 may be pulled at least partially out of housing 62, causing weight 68 to be lifted within left frame segment 22. Latch 74 may cooperate with hook 36 to hold rear display case door 12 in the open position. In some embodiments, one or more of magnets 78 magnetically engage a sliding bearing 50 coupled to rear display case door 12 when rear display case door 12 is in the open position. The magnetic force between magnets 78 and sliding bearing 50 may assist with holding rear display case door 12 in the open position. In some embodiments, magnets 78 are configured to apply a magnetic force sufficient to hold display case door 12 in the open position with or without assistance from latch 74.

Rear display case door 12 may disengage magnets 78 and/or latch 74 to begin sliding toward the closed position (i.e., to the left in FIG. 12). Weight 68 may apply a downward force to the bottom of cable 66, which is translated into a horizontal force as cable 66 bends within housing 62. The horizontal force may be transmitted through cable 66 and applied to display case door 12 (e.g., via sliding bearing 50 and/or suspension frame segment 26). The horizontal force causes display case door 12 to automatically slide toward the closed position. As rear display case door 12 approaches the closed position, one or more of magnets 76 may engage a sliding bearing 50 coupled to rear display case door 12. The magnetic force between magnets 76 and sliding bearing 50 may dampen the movement of rear display case door 12, thereby facilitating a soft closure of rear display case door 12.

The construction and arrangement of the elements of the sliding door assembly as shown in the various exemplary embodiments are illustrative only. Although only a few implementations of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited.

Numerous specific details are described to provide a thorough understanding of the disclosure. However, in certain instances, well-known or conventional details are not described in order to avoid obscuring the description. References to "some embodiments," "one embodiment," "an exemplary embodiment," and/or "various embodiments" in the present disclosure can be, but not necessarily are, references to the same embodiment and such references mean at least one of the embodiments.

Alternative language and synonyms may be used for anyone or more of the terms discussed herein. No special significance should be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

The elements and assemblies may be constructed from any of a wide variety of materials that provide sufficient strength or durability, in any of a wide variety of colors, textures, and combinations. Further, elements shown as integrally formed may be constructed of multiple parts or elements.

As used herein, the word "exemplary" is used to mean serving as an example, instance or illustration. Any implementation or design described herein as "exemplary" is not necessarily to be construed as preferred or advantageous over other implementations or designs. Rather, use of the word exemplary is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary implementations without departing from the scope of the appended claims.

As used herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

As used herein, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The background section is intended to provide a background or context to the invention recited in the claims. The description in the background may include concepts that could be pursued, but are not necessarily ones that have been previously conceived or pursued. Therefore, unless otherwise indicated herein, what is described in the background section is not prior art to the description and claims in this application and is not admitted to be prior art by inclusion in the background section.

What is claimed is:

1. A sliding door assembly for a refrigerated display case, the sliding door assembly comprising:

a door frame comprising a top frame segment defining a plurality of substantially horizontal and parallel channels;

a plurality of sliding bearings positioned within and supported by the substantially horizontal and parallel channels and configured to slide along the top frame segment within the substantially horizontal and parallel channels;

a plurality of display case doors suspended from the plurality of sliding bearings and configured to slide, along with the plurality of sliding bearings, between an open position and a closed position, the plurality of display case doors comprising a first display case door and a second display case door;

an automatic closure system coupled to the plurality of display case doors and configured to apply a closing force that automatically returns the plurality of display case doors to the closed position; and a first magnet coupled to the door frame and positioned relative to the first display case door and the second display case door such that the first magnet is configured to apply both:

a magnetic damping force to the first display case door as the first display case door approaches the closed position, the magnetic damping force opposing the closing force applied by the automatic closure system and damping a closure of the first display case door; and a magnetic holding force to the second display case door when the second display case door is in the open position, the magnetic holding force opposing the closing force applied by the automatic closure system and holding the second display case door in the open position.

2. The sliding door assembly of claim 1, wherein:

the plurality of substantially parallel channels comprise a front channel and a rear channel;

the plurality of sliding bearings comprise a front set of sliding bearings that slide within the front channel and a rear set of sliding bearings that slide within the rear channel;

the front display case door is suspended from the front set of sliding bearings and the rear display case door is suspended from the rear set of sliding bearings.

3. The sliding door assembly of claim 1, wherein:

the top frame segment has an open bottom face;

each of the plurality of display case doors comprises a suspension frame segment along a top of the display case door, each suspension frame segment extending through the open bottom face of the top frame segment and attaching to one or more of the plurality of sliding bearings.

4. The sliding door assembly of claim 1, wherein each of the plurality of sliding bearings comprises:

a body comprising a ball bearing carriage configured to slide substantially horizontally within the top frame segment; and one or more posts extending substantially horizontally from the body, wherein the plurality of display case doors are suspended from the one or more posts.

5. The sliding door assembly of claim 1, wherein:

the plurality of sliding bearings comprise a magnetic material; and the first magnet magnetically engages the plurality of sliding bearings as the first display case door approaches the closed position.

6. The sliding door assembly of claim 1, wherein the first magnet is fixed to the top frame segment.

7. The sliding door assembly of claim 6, wherein the first magnet is fixed to an exterior of the top frame segment outside the plurality of substantially horizontal and parallel channels and configured to apply the magnetic damping force through the top frame segment to one or more of the sliding bearings within the substantially horizontal and parallel channels.

8. The sliding door assembly of claim 1, further comprising a second magnet coupled to the door frame and positioned relative to the first display case door and the second display case door such that the second magnet is capable of applying both:

the magnetic damping force to the second display case door as the second display case door approaches the closed position, the magnetic damping force opposing the closing force applied by the automatic closure system and damping a closure of the second display case door; and the magnetic holding force to the first display case door when the first display case door is in the open position, the magnetic holding force opposing the closing force applied by the automatic closure system and holding the first display case door in the open position.

9. The sliding door assembly of claim 1, further comprising one or more latches configured to engage the plurality of display case doors in the open position and to hold the plurality of display case doors in the open position.

10. A sliding door assembly for a refrigerated display case, the sliding door assembly comprising:

a door frame comprising a top frame segment defining a front channel and a rear channel substantially parallel to the front channel;

a plurality of sliding bearings comprising:

a front set of sliding bearings positioned within and supported by the front channel and configured to slide along the top frame segment within the front channel, and a rear set of sliding bearings positioned within and supported by the rear channel and configured to slide along the top frame segment within the rear channel;

a plurality of display case doors comprising:

a front display case door suspended from the front set of sliding bearings and configured to slide with the front set of sliding bearings along the front channel, and a rear display case door suspended from the rear set of sliding bearings and configured to slide with the rear set of sliding bearings along the rear channel;

an automatic closure system coupled to the plurality of display case doors and configured to apply a closing force that automatically returns the plurality of display case doors to a closed position; and a magnet coupled to the door frame and positioned relative to the front set of sliding bearings and the rear set of sliding bearings such that the magnet is configured to apply both:

a magnetic damping force to the front set of sliding bearings as the front display case door approaches the closed position, the magnetic damping force opposing the closing force applied by the automatic closure system and damping a closure of the front display case door; and a magnetic holding force to the rear set of sliding bearings when the rear display case door is in the open position, the magnetic holding force opposing the closing force applied by the automatic closure system and holding the rear display case door in the open position.

11. The sliding door assembly of claim 10, wherein the automatic closure system comprises a weight suspended within a side segment of the door frame and coupled to one of the plurality of display case doors via a cable.

12. The sliding door assembly of claim 10, wherein the magnet is fixed to an interior of the top frame segment within the rear channel and configured to apply the magnetic damping force to the front set of sliding bearings within the front channel through a center wall of the top frame segment.

13. The sliding door assembly of claim 10, wherein the magnet is fixed to an exterior of the top frame segment outside the plurality of substantially horizontal and parallel channels and configured to apply the magnetic damping force through the top frame segment to the front set of sliding bearings within the front channel.

* * * * *